US009526929B2

(12) United States Patent
Dedina et al.

(10) Patent No.: US 9,526,929 B2
(45) Date of Patent: Dec. 27, 2016

(54) FIRE PROTECTION DEVICE OF AN ELECTRIC INSTALLATION STARTER-CONTROLLER DEVICE

(71) Applicant: Schneider Electric Industries SAS, Rueil-Malmaison (FR)

(72) Inventors: Gregory Dedina, Vourey (FR); Bernard Loiacono, Seyssinet (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 39 days.

(21) Appl. No.: 14/555,845

(22) Filed: Nov. 28, 2014

(65) Prior Publication Data

US 2015/0151148 A1 Jun. 4, 2015

(30) Foreign Application Priority Data

Dec. 2, 2013 (FR) ..... 13 61946

(51) Int. Cl.
*A62C 2/00* (2006.01)
*A62C 2/24* (2006.01)
(Continued)

(52) U.S. Cl.
CPC ..... *A62C 2/247* (2013.01); *A62C 3/16* (2013.01); *A62C 37/40* (2013.01); *H01H 35/38* (2013.01);
(Continued)

(58) Field of Classification Search
CPC ..... A62C 37/40; A62C 3/16
(Continued)

(56) References Cited

U.S. PATENT DOCUMENTS 5,936,531 A * 8/1999 Powers ..... G08B 17/00 169/60
6,317,053 B1 11/2001 Seeliger et al.
(Continued)

FOREIGN PATENT DOCUMENTS

DE 203 17 604 U1 3/2004
DE 20 2006 021 001 U1 1/2012
EP 2 556 857 A1 2/2013

OTHER PUBLICATIONS

French Preliminary Search Report issued Aug. 14, 2014 in French application 13 61946, filed on Dec. 2, 2013 ( with English Translation of Categories of Cited Documents).

*Primary Examiner* — Arthur O Hall
*Assistant Examiner* — Viet Le
(74) *Attorney, Agent, or Firm* — Oblon, McClelland, Maier & Neustadt, L.L.P.

(57) ABSTRACT

The invention relates to a fire protection device (10) for a starter-controller device (2) of an electrical installation, the starter-controller device (2) comprising at least one connection terminal, each connection terminal being adapted to be connected to an electrical conductor, the protection device (10) comprising thermal monitoring means for the or each electrical conductor adapted to detect a temperature increase, at each connection terminal, above a predetermined threshold. This protection device is suitable for being mechanically fastened to the starter-controller device (2) via at least one mechanical connection member (16). The thermal monitoring means comprise at least one temperature sensor (36*a*, 36*b*, 36*c*) able to sense a temperature in a first hollow housing (8*a*, 8*b*, 8*c*) of the starter-controller device (2) situated near a connection terminal of a conductor. This protection device further includes an injection device (30), electrically connected to said at least one temperature sensor (36*a*, 36*b*, 36*c*), adapted to inject a fire extinguishing agent
(Continued)

toward the first hollow housing(s) (8*a,* 8*b,* 8*c*) once the temperature sensor (36*a,* 36*b,* 36*c*) has detected a temperature above the predetermined threshold.

11 Claims, 6 Drawing Sheets

(51) Int. Cl.

| | |
|---|---|
| ***A62C 3/16*** | (2006.01) |
| ***H01H 35/38*** | (2006.01) |
| ***A62C 37/40*** | (2006.01) |
| *H01H 71/02* | (2006.01) |
| *A62C 35/13* | (2006.01) |
| *H01H 89/06* | (2006.01) |

(52) U.S. Cl.
CPC ..... *A62C 35/13* (2013.01); *H01H 89/06* (2013.01); *H01H 2071/0278* (2013.01); *H01H 2071/0292* (2013.01); *H01H 2239/06* (2013.01)

(58) Field of Classification Search
USPC ..... 169/61
See application file for complete search history.

(56) References Cited

U.S. PATENT DOCUMENTS

| | | | | |
|---|---|---|---|---|
| 2008/0190627 | A1* | 8/2008 | Koelewijn | A62C 5/006 169/46 |
| 2010/0025053 | A1* | 2/2010 | Chesley | A62C 3/16 169/56 |

* cited by examiner

FIRE PROTECTION DEVICE OF AN ELECTRIC INSTALLATION STARTER-CONTROLLER DEVICE

The present invention relates to a fire protection device for a starter-controller device of an electrical installation, the starter-controller device comprising at least one connection terminal, each connection terminal being adapted to be connected to an electrical conductor.

It also relates to an associated fire protection system.

The invention belongs to the field of fire protection in starter and control devices for electrical installations.

Such starter and control devices for electrical installations comprise electrical power conductors provided with poles with separable contacts. The electrical conductors are connected at connection terminals. One of the main known causes of fire is the loosening of the connection terminals, which causes a temperature increase in the starter-controller device at the connection terminals, the energy stored following that temperature increase being able to cause thermal seizing and a fire outbreak. A fire caused locally spreads quickly at the electrical panel of the electrical installation, or even the buildings electrically connected by the electrical installation.

It is known to monitor a temperature increase at connection terminals using thermal monitoring means.

Document FR2979149 describes a thermal monitoring system for the connection terminals of the electrical connection device. The proposed system makes it possible, if the thermal monitoring means detects a temperature increase above a predetermined threshold, to cut the connections of the electrical connection device. However, in the case of a fire outbreak, simply cutting the electrical connections does not make it possible to stop the progress of the fire, and such a system therefore does not guarantee sufficient safety in the event a fire has already broken out.

The present invention aims to resolve this drawback, by proposing a device making it possible to provide better safety in case of fire outbreak.

To that end, the invention proposes a fire protection device for a starter-controller device of an electrical installation, the starter-controller device comprising at least one connection terminal, each connection terminal being adapted to be connected to an electrical conductor, the protection device comprising thermal monitoring means for the or each electrical conductor able to detect a temperature increase, at each connection terminal, above a predetermined threshold.

This fire protection device is suitable for being mechanically fastened to the starter-controller device via at least one mechanical connection, said thermal monitoring means comprising at least one temperature sensor able to sense a temperature in a first hollow housing of the starter-controller device situated near a connection terminal of a conductor. Furthermore, the fire protection device includes an injection device, electrically connected to said at least one temperature sensor, able to inject a fire extinguishing agent toward the first hollow housing(s) once the temperature sensor has detected a temperature above the predetermined threshold.

Advantageously, the device according to the invention includes a device for injecting a fire extinguishing agent, implemented when a temperature sensor detects a temperature above a predetermined threshold near a connection terminal of the starter-controller device. Thus, when a temperature above the predetermined threshold is detected, a fire extinguishing agent is released so as to extinguish any fire outbreak and avoid the propagation of fire at the connected electrical installation.

The protection device according to the invention may also have one or more of the features below, considered independently or combined according to all technically possible combinations:

- the injection device includes a cartridge containing said fire extinguishing agent, a striker element able to pierce said cartridge to release its contents, the striker element being electrically connected to said at least one temperature sensor, and at least one injection orifice able to inject said fire extinguishing agent, the injection orifice(s) each being adapted to be embedded in a so-called first hollow housing of the starter-controller device situated near a connection terminal of said starter-controller device;
- it further includes a trigger element, kept in a first idle position by a fastening piston as long as the temperature sensor(s) indicate a temperature below the predetermined threshold, said trigger element being able to move toward a second locking position when the fastening piston moves away from the trigger element, the movement of the fastening piston from a contact position with said trigger element to a non-contact position with said trigger element being done following the release of fire extinguishing agents;
- it further includes a mobile contact holder element and an electrical connection control connecting element protruding on a face of the protection device, said mobile contact holder element being mechanically connected to said electrical connection control connecting element, the electrical connection control connecting element being adapted to plug into a second housing of the starter-controller device and actuate a connection/disconnection mechanism of each electrical conductor in the corresponding connection terminal, said trigger element being able, when it is in the second locked position, to fasten the mobile contact holder element so as to keep the electrical connection control connecting element in the disconnected position of each electrical conductor in the corresponding connection terminal;
- when each electrical conductor of the starter-controller device is connected in the corresponding connection terminal, the trigger element is able, when it moves from the first idle position to the second locked position, to move the mobile contact holder element to drive a movement of the electrical connection control connecting element resulting in driving a disconnection of each electrical conductor in the corresponding connection terminal;
- it includes a pair of auxiliary electrical contacts, each pair of auxiliary electrical contacts being made up of a fixed auxiliary contact and a corresponding moving auxiliary contact, the moving auxiliary contact being adapted to disconnect from the corresponding fixed auxiliary contact following the release of fire extinguishing agents so as to transmit operating information from said protection device;
- said fire extinguishing agent is a gas or foam;
- said predetermined temperature threshold is 110° C.

According to a second aspect, the invention relates to a fire protection system of an electrical installation, comprising a starter-controller device for the electrical installation and a fire protection device as briefly described above, the fire protection device being adapted to be fastened to the starter-controller device.

According to one feature, the fire protection device can be fastened on a side face of the starter-controller device.

According to one feature, the starter-controller device comprises a control member for connecting electrical conductors in the connection terminals and the fire protection device comprises an electrical connection control connecting element adapted to control said control member.

Other features and advantages of the invention will emerge from the description thereof provided below, for information and non-limitingly, in reference to the appended figures, in which:

FIG. 1 illustrates a complete fire protection system 1, comprising a starter-controller device 2 adapted to be connected to an electrical installation via electrical conductors not shown in the figure.

Such a starter-controller device 2 performs a protection and control function for single-phase or three-phase motors, in particular implementing a protection function against overintensities (or circuit breaker function) and an insulation and power sectioning function.

The electrical connectors can each be connected to the starter-controller device 2 at a respective connection terminal 6*a*, 6*b*, 6*c*.

For example, three connection terminals are provided for the three-phase current phase electrical conductors.

More generally, a number of connection terminals between 2 and 4 is considered.

Below the connection terminals 6*a*, 6*b*, 6*c* are housings or orifices 8*a*, 8*b*, 8*c*, called first housings, which are provided in the starter-controller device to discharge circuit breaker gas in the event an electric arc is present.

The system 1 also comprises a fire protection device 10 that can be connected to the starter-controller device 2 and protect that device 2 from any fire outbreak due to a temperature increase above a predetermined threshold, denoted threshold S, at the level of the orifices 8*a*, 8*b*, 8*c*.

Figure 2:
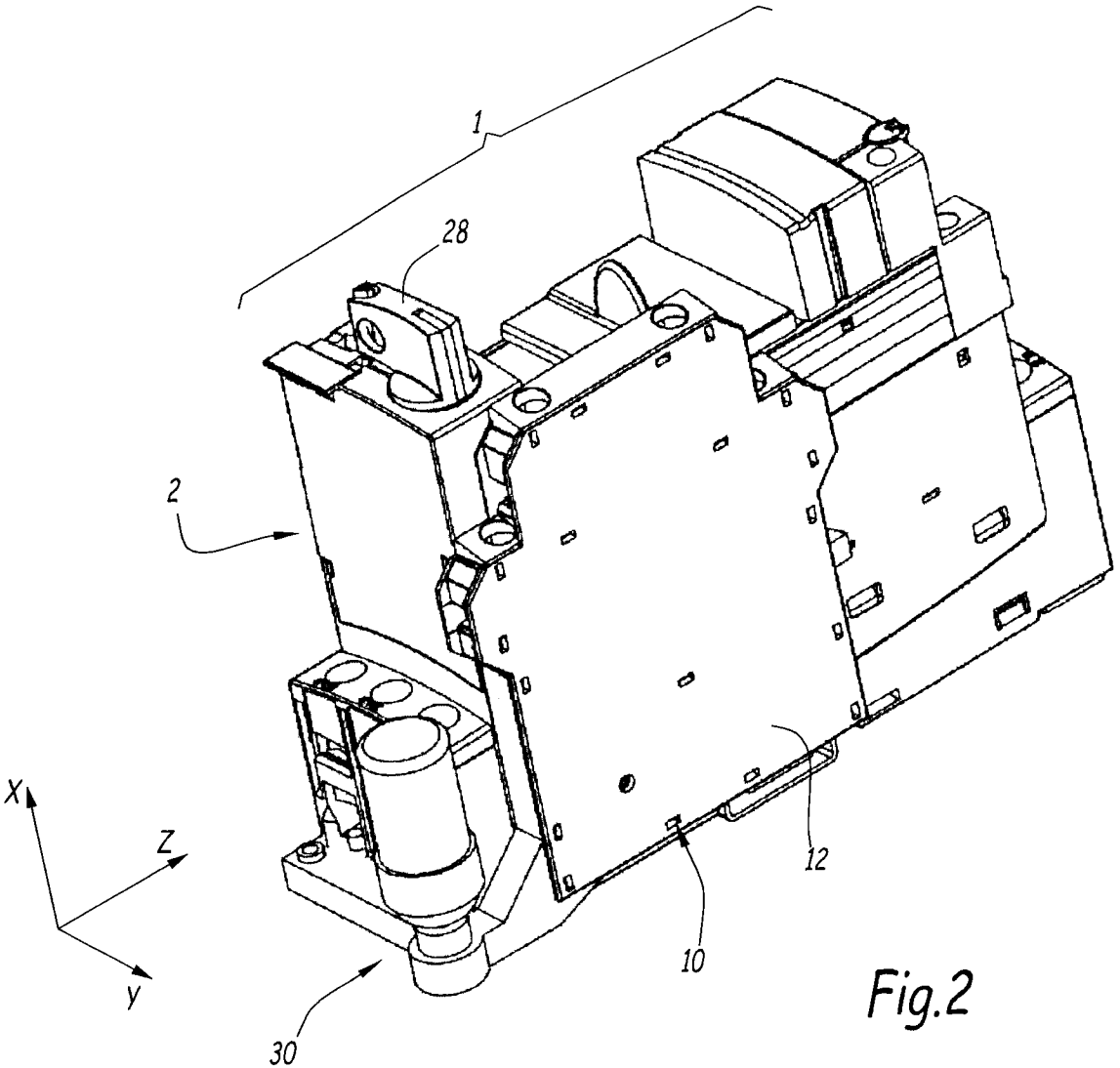
FIG. 2 shows a perspective view of the protection system of FIG. 1, in which the fire protection device is fastened on the starter-controller device.

The protection device 10 includes a housing 12, preferably with a substantially parallelepiped shape, of small width l, comprised between 0 and 10 millimeters (mm), a height H similar to the height of the starter-controller device 2 and a width L smaller than or equal to the width L' of a side face 14 of the starter-controller device 2 on which that protection device 10 is suitable for being fastened, as illustrated in the view of the system 1 in FIG. 2.

The housing 12 comprises at least one mechanical connecting member 16, protruding on a side face 18 of the housing. This mechanical connecting member 16 is suitable for being embedded in a corresponding hollow housing 20 to the side face 14 of the starter-controller device 2.

Figure 1:
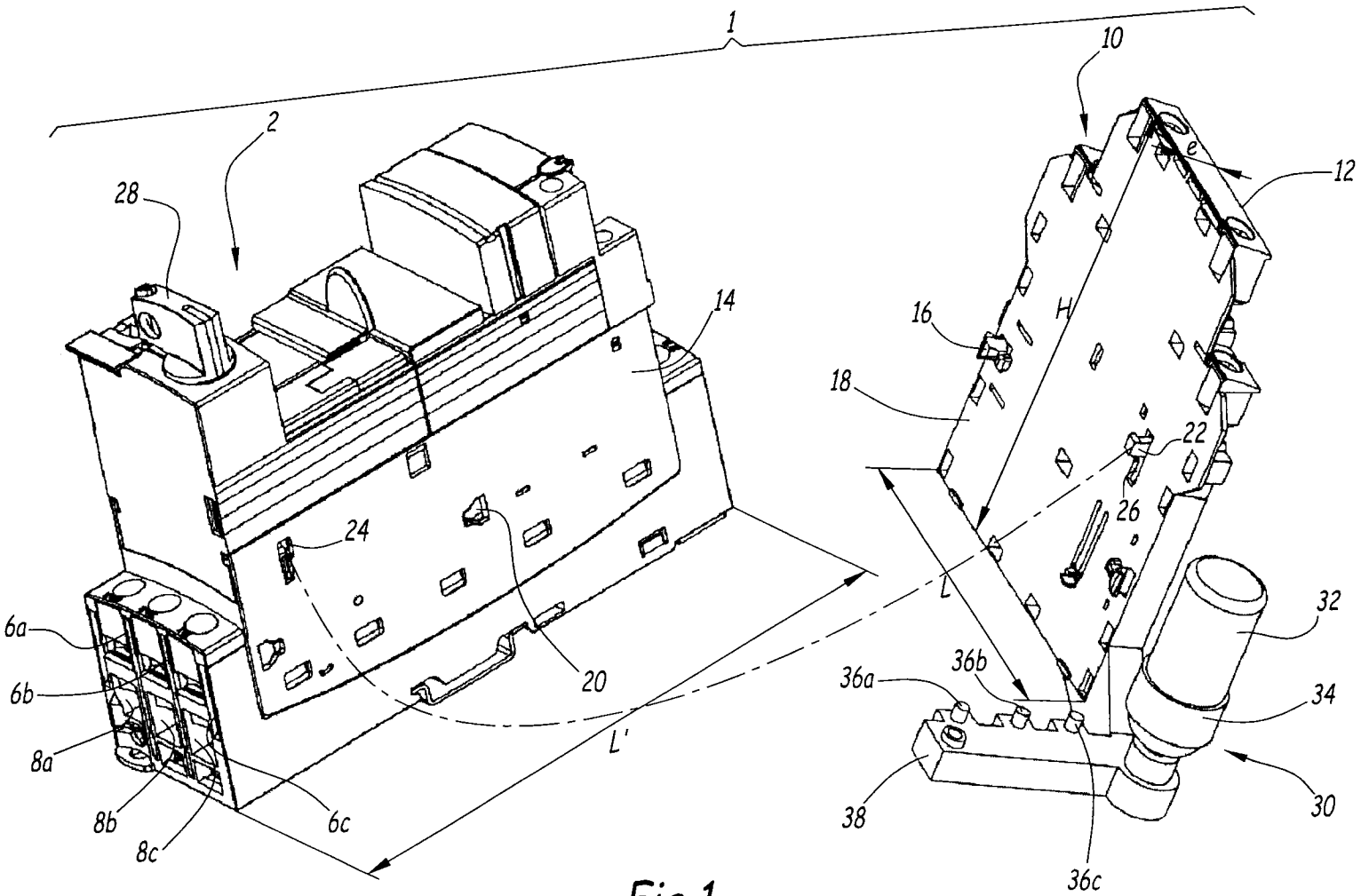
FIG. 1 shows an exploded perspective view of the fire protection system according to one embodiment of the invention.

Furthermore, the housing 12 comprises, protruding on the same side face 18, an electrical connection control connecting element 22, adapted to plug into a second hollow housing 24 of the side face 14 of the starter-controller device 2, as indicated by the connection in dotted lines in FIG. 1. The electrical connection control connecting element 22 is movable in a slot 26 of the face 18 of the housing, and is led, according to an operation that will be described below, to be positioned between two distinct positions. In a correlated manner, the second hollow housing 24 allows the movement of the electrical connection control connecting element 22 between two distinct positions.

When the protection device 10 is fastened to the starter-controller device 2, the connecting element 22 is connected to a lock mechanism allowing the opening and closing of the electrical connection of the conductors in their respective connection terminals.

Thus, the position of the connecting element 22 can control the connection state of the electrical conductors. Furthermore, an electrical connection or disconnection of the electrical conductors is controlled manually by actuating the control member 28 of the starter-controller device 2.

In the proposed system 1, changing the position of the electrical connection control connecting element 22 from a position corresponding to an electrical connection to a position corresponding to an electrical disconnection makes it possible to modify the position of the control member 28. Thus, a change in position of the electrical connection control connecting element 22 makes it possible to change the electrical connection status of the conductors.

Furthermore, the protection device 10 makes it possible, via the electrical connection control connecting element 22, to maintain the locked disconnection position locked following the detection of a fire outbreak.

The protection device 10 further includes an injection device 30 for injecting a fire extinguishing agent.

This device 30 comprises, in the embodiment illustrated in FIG. 1, a cartridge 32 containing the fire extinguishing agent. Such an agent is for example a gas, for example $CO_2$, or a foam. In general, any type of fluid or gaseous agent for extinguishing electrical fires can be used.

The device 30 also comprises a striker element 34, adapted to pierce the cartridge 32 to release the contents thereof, and temperature sensors 36*a*, 36*b*, 36*c* provided with injection orifices, through which the fire extinguishing agent can exit, fastened on a platen 38.

The sensors 36*a*, 36*b*, 36*c* are adapted to be embedded in the first housings 8*a*, 8*b*, 8*c* of the starter-controller device 2, so as to detect the temperature level of the first housings 8*a*, 8*b*, 8*c*. Thus, the temperature near the connection terminals 6*a*, 6*b*, 6*c* is monitored via the temperature sensors 36*a*, 36*b*, 36*c*.

The temperature sensors 36*a*, 36*b*, 36*c* are electrically connected to the striker element 34, so as to allow it to be activated when the temperature exceeds a predetermined threshold S.

Preferably, the temperature threshold S is 110° C.

Figure 3:
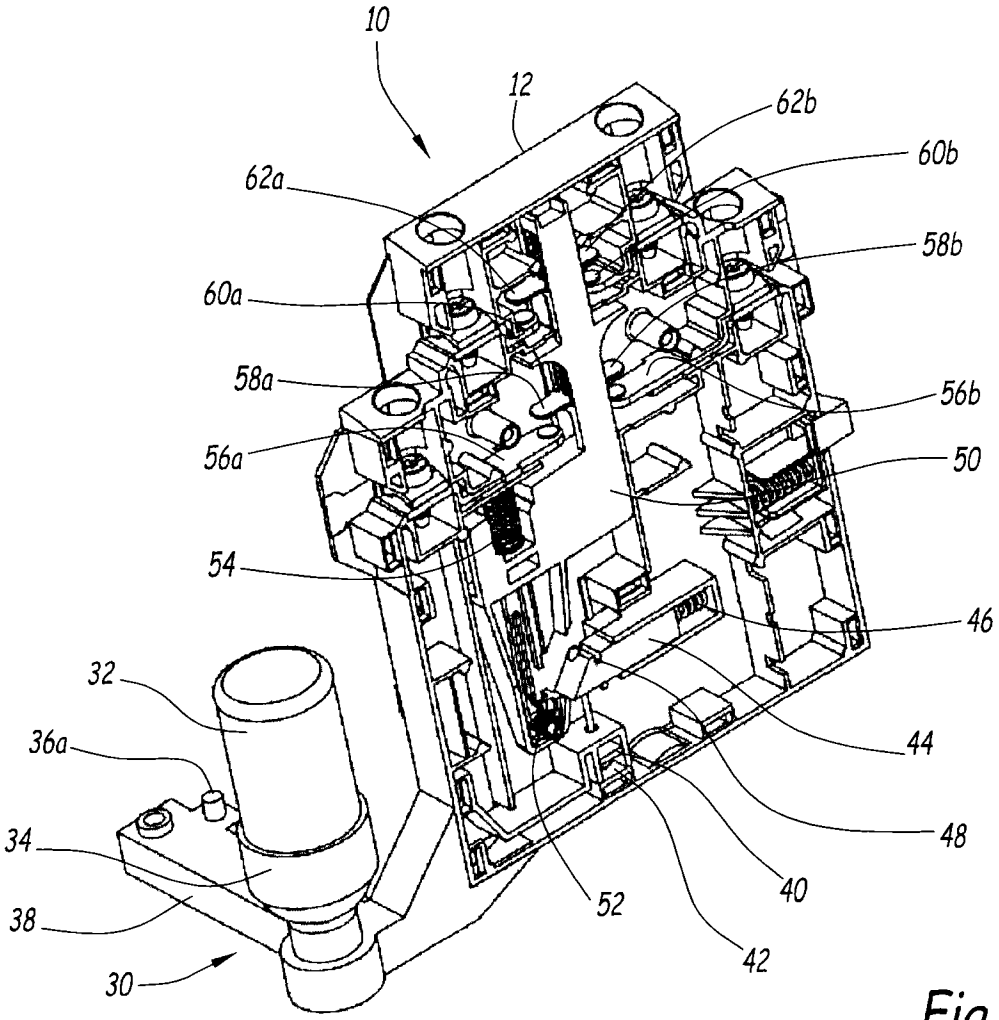
FIG. 3 shows a detailed view of a fire protection device according to one embodiment of the invention.

FIG. 3 is a detailed illustration of a protection device 10 according to one embodiment, in longitudinal cross-section. As already illustrated in FIGS. 1 and 2 above, the injection device 30 is positioned orthogonally relative to the housing 12, such that the injection device is fastened on a front face of the starter-controller device 2, while the housing 12 is fastened on a side face 14 of the starter-controller device 2.

The injection device 30 is fastened to the housing 12 by a mechanical connection.

Inside the housing 12, the protection device comprises a fastening piston 40 associated with a fastening spring 42.

The fastening piston 40 can maintain a trigger element 44, also associated with a spring 46. The spring 46 is placed at one of the sides of the trigger element 44, opposite a beveled side, including a notch 48, adapted to cooperate with a mobile contact holder element 50, bearing the connecting element 22 for controlling the electrical connection. The connecting element 22 is not visible in FIG. 3 because it is situated on the rear face 18 of the protection device 10.

The mobile contact holder 50 is maintained by a compression spring 54, which, in the idle position, keeps the mobile contact holder 50 in a high position corresponding to a disconnection position of conductors in the connection terminals of the starter-controller device 2.

During operation, when the trigger element 44 is released, it moves along the axis −Z and comes into contact with one end 52 of the mobile contact holder 50, the shape of which is suitable for being inserted into the notch 48 for fastening, as explained in more detail below in reference to FIGS. 4 to 7.

Furthermore, the protection device 10 includes several pairs of auxiliary electrical contacts making it possible to send safety information, for example to turn on visual operating indicators, if fire protection operation is activated.

Thus, the protection device 10 comprises two lower auxiliary contacts each comprising a lower auxiliary fixed contact 56*a*, 56*b* and a lower auxiliary moving contact 58*a*, 58*b*. It also comprises two upper auxiliary contacts each comprising an upper auxiliary fixed contact 60*a*, 60*b* and an upper auxiliary moving contact 62*a*, 62*b*.

The auxiliary contacts are closed when the fire protection device 10 is idle and the temperature sensed by the temperature sensors 36*a*, 36*b*, 36*c* is below the predetermined threshold S, and they are mechanically and electrically opened when the fire protection device enters the actual protection mode and releases the extinguishing agent.

The operation of the fire protection device 10 will be described below in reference to FIGS. 4 to 7, which illustrate elements of this protection device in longitudinal cross-section.

Figure 4:
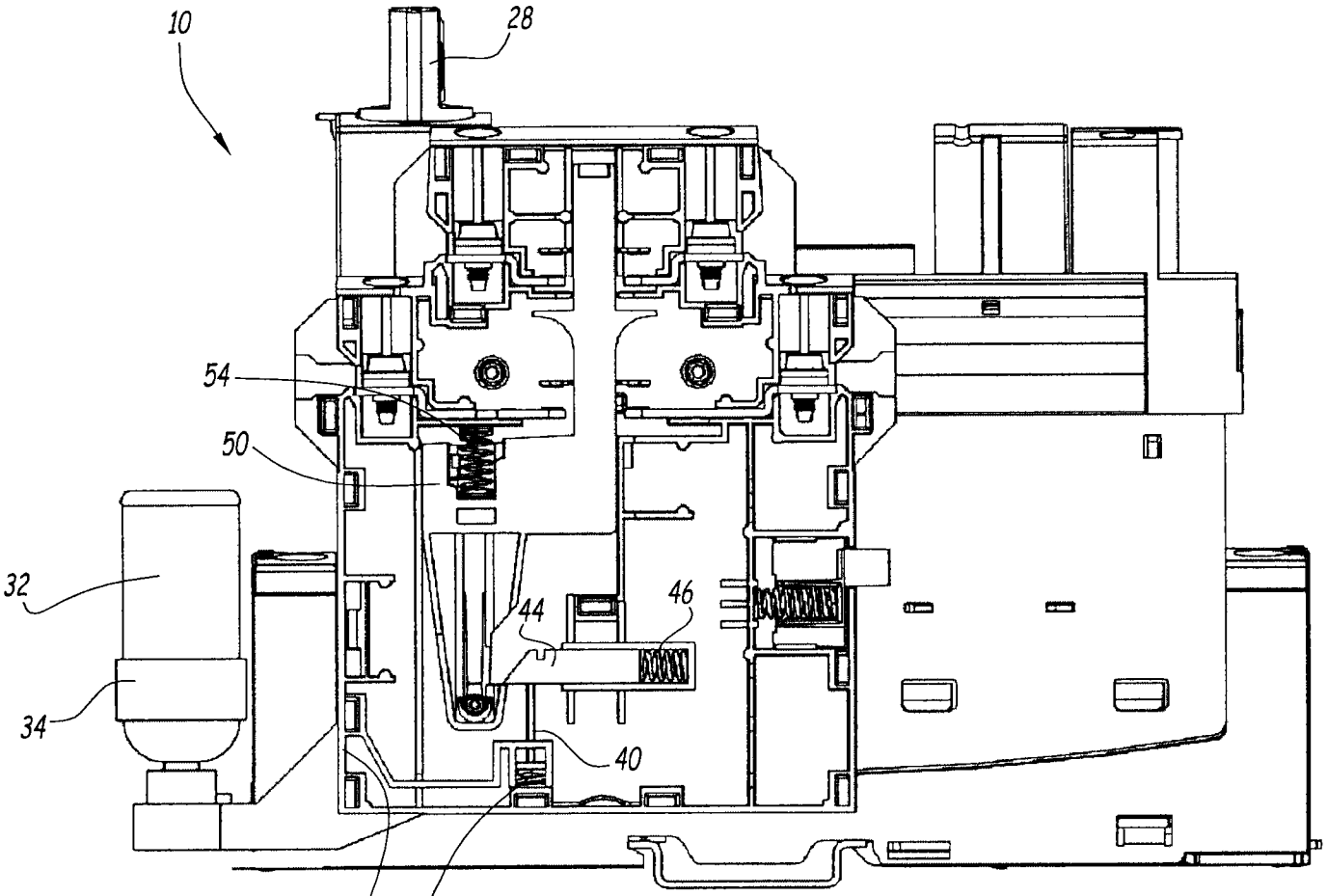
FIGS. 4 to 7 illustrate the operation of the fire protection device.

FIG. 4 illustrates the fire protection device 10 when it is fastened to a starter-controller device 2, in a situation where the starter-controller device 2 is in the electrical disconnection state ("off" position), the conductors being loosened in their respective connection terminals, and there has not been any detection by the protection device 10 of a temperature above the predetermined temperature threshold.

The fastening piston 40 is in contact with the trigger element 44, in a first idle position. The spring 46 is compressed when the trigger element 44 is in the first idle position.

The mobile contact holder 50 is in the high position maintained by the compression spring 54.

Figure 5:
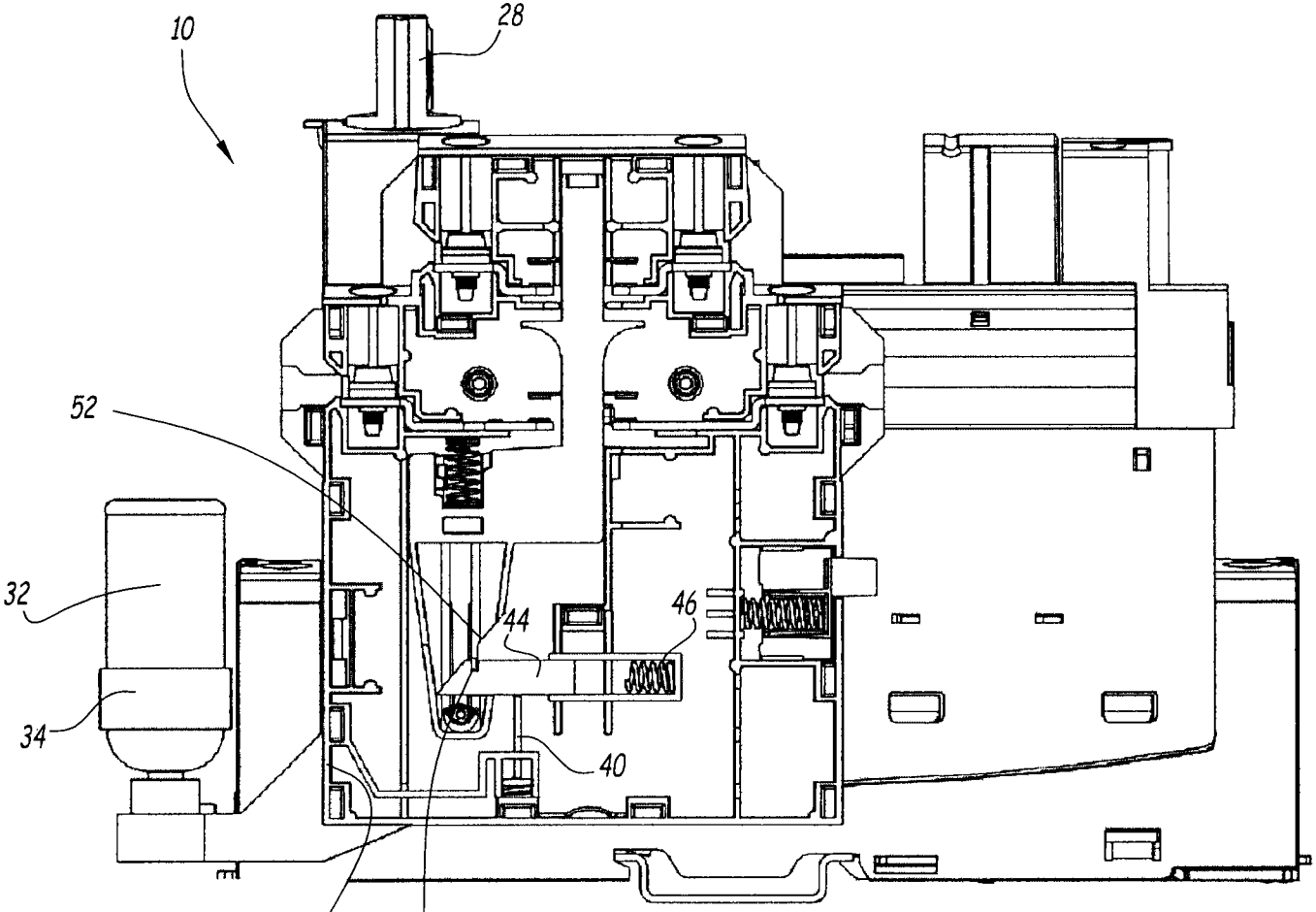

FIG. 5 illustrates the fire protection device when it is fastened to a starter-controller device 2, in a situation where the starter-controller device 2 is in the electrical disconnection state ("off" position), and the protection device 10 has detected a temperature above the predetermined threshold temperature S, and the actual fire protection is triggered.

When a temperature above the predetermined temperature threshold S for at least one of the sensors 36*a*, 36*b*, 36*c* is detected, the striker element 34 is triggered and pierces the cartridge 32, which causes the extinguishing agent to be released through the platen 38 toward the hollow housings 8*a*, 8*b*, 8*c* situated below the connection terminals 6*a*, 6*b*, 6*c*.

At the same time, the release of the extinguishing agent causes the release of fluid through an orifice 64 toward the chamber of the fastening piston 40 and consequently causes the fastening piston 40 to move downward, in the direction −X according to the reference shown in FIG. 2.

The trigger element 44 is released during the movement of the fastening piston 40, and moves, under the impulse of the spring 46, in direction −Z, toward a second locking position.

The notch 48 cooperates with a suitable portion 52 of the mobile contact holder 50, so as to lock the mobile contact holder 50 in the high position, which corresponds to a disconnection position of the starter-controller device 2.

This locking results in preventing a manual restoration of contact, via the control member 28, of the starter-controller device 2.

Advantageously, safety is ensured, any fire propagation being prevented owing to that locking.

Figure 6:
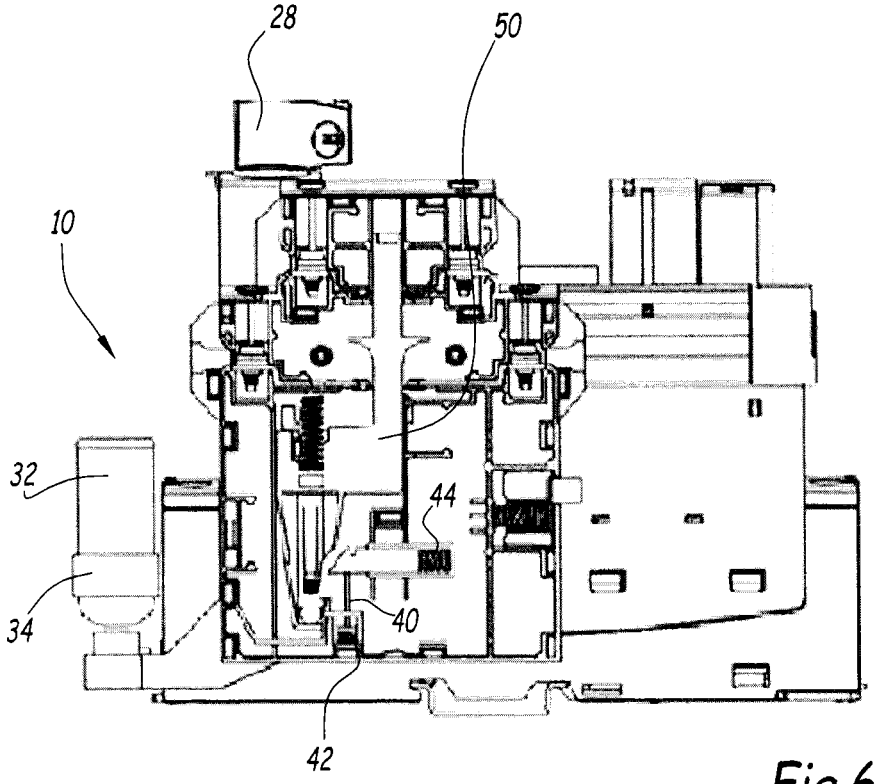

FIG. 6 illustrates the fire protection device 10 when it is fastened to a starter-controller device 2, in a situation where the starter-controller device 2 is in the electrical connection state ("on" position), and the protection device 10 has not detected a temperature above the predetermined temperature threshold.

The fastening piston 40 is in contact with the trigger element 44, in a first idle position, as described above in reference to FIG. 4.

The mobile contact holder 50 is in the low position, based on the "on" position of the control member 28 of the starter-controller.

Figure 7:
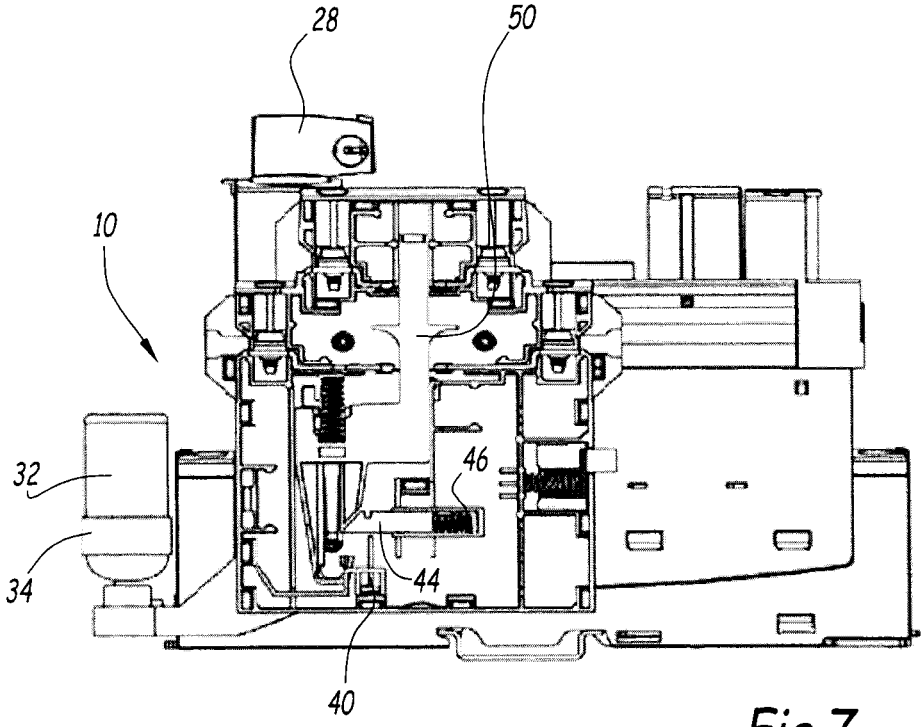

FIG. 7 illustrates the fire protection device 10 when it is fastened to a starter-controller device 2, in a situation where the starter-controller device 2 is in the connection state ("on" position), and the protection device 10 has detected a temperature above the predetermined temperature threshold S, and so actual fire protection is triggered.

The illustration of FIG. 7 corresponds to an operating state of the fire protection device 10 during establishment of the fire protection, before completion of the locking of the connection of the starter-controller device 2.

As already explained in reference to FIG. 5, when a temperature is detected above the predetermined temperature threshold for at least one of the sensors 36*a*, 36*b*, 36*c*, the striker element 34 is triggered and pierces the cartridge 32, which causes the extinguishing agent to be released through the platen 38 toward the hollow housings 8*a*, 8*b*, 8*c* situated below the connection terminals 6*a*, 6*b*, 6*c*.

At the same time, the release of the extinguishing agent causes the fastening piston 40 to move downward, in the direction −X according to the reference shown in FIG. 2.

The trigger element 44 is released during the movement of the fastening piston 40, and moves, under the impulse of the spring 46, in direction −Z, toward a second locking position.

The trigger element 44 comes into contact with one end of the mobile contact holder 50 and causes the mobile contact holder 50 to move upward, in the direction X, which causes a change in position of the electrical connection control connecting element 22, and consequently a change in the connection state of the conductors.

This movement causes the modification of the position of the control member 28 to a disconnection (off) position of the starter-controller.

Lastly, the notch 48 cooperates with a suitable portion 52 of the mobile contact holder 50, so as to fasten the mobile contact holder 50 in the high position, which corresponds to the disconnection position of the starter-controller device 2.

This locking results in preventing a manual restoration of contact, via the control member 28, of the starter-control device. The final position of the fire protection device 10 is similar to the position illustrated in FIG. 5.

Advantageously, the fire protection device according to the invention makes it possible to act to extinguish any fire outbreak at the connection terminals of the power conductors of a starter-controller device of an electrical installation, while ensuring electrical disconnection and maintenance in the disconnected position.

The invention claimed is:

1. A fire protection device for a starter-controller device of an electrical installation, the starter-controller device comprising at least one connection terminal, each connection terminal being connectable to an electrical conductor, the protection device comprising:

thermal monitoring sensors, for each electrical conductor, which are able to detect a temperature increase, at each connection terminal, to above a predetermined threshold, wherein the fire protection device is mechanically fastenable to the starter-controller device via at least one mechanical connection member, wherein the thermal monitoring sensors comprise one or more temperature sensors able to sense a temperature in first one or more hollow housings of the starter-controller device situated near a connection terminal of a conductor, the fire protection device including an injection device, electrically connected to said one or more temperature sensors, configured to inject a fire extinguishing agent toward the first one or more hollow housings once the one or more temperature sensors have detected a temperature above the predetermined threshold, and wherein the fire protection device further comprises a trigger element, kept in a first idle position by a fastening piston as long as the one or more temperature sensors indicate a temperature below the predetermined threshold, said trigger element is able to move toward a second locking position when the fastening piston moves away from the trigger element, the movement of the fastening piston from a contact position with said trigger element to a non-contact position with said trigger element being done following the release of the fire extinguishing agent.

2. The protection device according to claim 1, wherein the injection device includes a cartridge containing said fire extinguishing agent, a striker element able to pierce said cartridge to release contents of the cartridge, the striker element being electrically connected to said one or more temperature sensors, and one or more injection orifices able to inject said fire extinguishing agent, each of the one or more injection orifices being configured to be embedded in the first one or more hollow housings of the starter-controller device situated near the connection terminal of said starter-controller device.

3. The protection device according to claim 1, further including a mobile contact holder element and an electrical connection control connecting element protruding on a face of the protection device, said mobile contact holder element being mechanically connected to said electrical connection control connecting element, the electrical connection control connecting element being configured to plug into a second housing of the starter-controller device and actuate a connection/disconnection mechanism of each electrical conductor in the corresponding connection terminal, said trigger element being able, when it is in the second locked position, to fasten the mobile contact holder element to keep the electrical connection control connecting element in the disconnected position of each electrical conductor in the corresponding connection terminal.

4. The protection device according to claim 3, wherein, when each electrical conductor of the starter-controller device is connected in the corresponding connection terminal, the trigger element is able, when it moves from the first idle position to the second locked position, to move the mobile contact holder element to drive a movement of the electrical connection control connecting element resulting in driving a disconnection of each electrical conductor in the corresponding connection terminal.

5. The protection device according to claim 1, including a pair of auxiliary electrical contacts, each pair of auxiliary electrical contacts being made up of a fixed auxiliary contact and a corresponding moving auxiliary contact, the moving auxiliary contact being configured to disconnect from the corresponding fixed auxiliary contact following the release of fire extinguishing agents thereby triggering the transmission of operating information from said protection device.

6. The protection device according to claim 1, wherein said fire extinguishing agent is a gas or foam.

7. The protection device according to claim 1, wherein said predetermined temperature threshold is 110° C.

8. A fire protection system of an electrical installation, comprising a starter-controller device for the electrical installation and a fire protection device according to claim 1, the fire protection device being configured to be fastened to the starter-controller device.

9. The fire protection system according to claim 8, wherein the fire protection device can be fastened on a side face of the starter-controller device.

10. The fire protection system according to claim 8, wherein the starter-controller device comprises a control member for connecting electrical conductors in the connection terminals and the fire protection device comprises an electrical connection control connecting element configured to control said control member.

11. A fire protection device for a starter-controller device of an electrical installation, the starter-controller device comprising at least one connection terminal, each connection terminal being connectable to an electrical conductor, the protection device comprising:

thermal monitoring means for each electrical conductor, which are able to detect a temperature increase, at each connection terminal, to above a predetermined threshold, wherein the fire protection device is mechanically fastenable to the starter-controller device via at least one mechanical connection member, wherein the thermal monitoring means is a means for sensing a temperature in first one or more hollow housings of the starter-controller device situated near a connection terminal of a conductor, the fire protection device including an injection device, electrically connected to said one or more temperature sensors, configured to inject a fire extinguishing agent toward the first one or more hollow housings once the one or more temperature sensors have detected a temperature above the predetermined threshold, and wherein the fire protection device further comprises a trigger element, kept in a first idle position by a fastening piston as long as the one or more temperature sensors indicates a temperature below the predetermined threshold, the movement of the fastening piston from a contact position with said trigger element to a non-contact position with said trigger element being done following the release of the fire extinguishing agent.

* * * * *